US006761027B2

(12) United States Patent
A'Hearn et al.

(10) Patent No.: US 6,761,027 B2
(45) Date of Patent: Jul. 13, 2004

(54) PRESSURE-COMPENSATED HYDRAULIC CIRCUIT WITH REGENERATION

(75) Inventors: Michael Anthony A'Hearn, Shorewood, IL (US); Daniel J. Mather, Lockport, IL (US); Srikrishnan Tirumalai Kumara Tolappa, deceased, late of Aurora, IL (US), by Rangamani Srikrishnan, legal representative

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/180,157

(22) Filed: Jun. 27, 2002

(65) Prior Publication Data

US 2004/0000228 A1 Jan. 1, 2004

(51) Int. Cl.[7] ..... F15B 11/08

(52) U.S. Cl. ..... 60/327; 60/420; 91/436; 91/445; 91/447

(58) Field of Search ..... 60/327, 420, 426; 91/436, 433, 445, 447

(56) References Cited

U.S. PATENT DOCUMENTS

| | | | | |
|---|---|---|---|---|
| 2,670,714 A | | 3/1954 | Gay et al. | 121/38 |
| 3,211,065 A | | 10/1965 | Hunger et al. | 91/516 |
| 3,461,780 A | | 8/1969 | Schmon | 91/433 |
| 4,024,798 A | | 5/1977 | Schexnayder et al. | 91/436 |
| 4,028,889 A | | 6/1977 | Budzich | 60/420 |
| 4,204,459 A | | 5/1980 | Johnson | 91/445 |
| 4,303,003 A | | 12/1981 | Reip | 91/453 |
| 4,617,854 A | | 10/1986 | Kropp | 91/517 |
| 5,067,389 A | * | 11/1991 | St. Germain | 91/446 |
| 5,207,059 A | * | 5/1993 | Schexnayder | 91/445 |
| 5,259,192 A | * | 11/1993 | Karakama et al. | 91/445 |
| 5,291,821 A | * | 3/1994 | Yamashita et al. | 81/447 |
| 5,353,686 A | | 10/1994 | Nakamura | 91/461 |
| 5,370,038 A | | 12/1994 | Poppe et al. | 91/436 |
| 5,752,426 A | | 5/1998 | Ikei et al. | 91/447 |
| 6,161,467 A | * | 12/2000 | A'Hearn et al. | 91/436 |

* cited by examiner

*Primary Examiner*—Thomas E. Lazo
(74) *Attorney, Agent, or Firm*—Finnegan, Henderson, Farabow, Garrett & Dunner; Steve M Hanley

(57) ABSTRACT

A fluid system includes first and second control valves that control fluid communication with first and second actuators. The first control valve may combine fluid flow from a second end port of the first actuator with fluid flow from a pressurized fluid source when providing a supply of fluid to a first end port of the first actuator. The first and second control valves include first and second signal ports in fluid communication with the supply of fluid to the first and second actuators. A resolver outputs a resolved signal pressure equal to the greater of a first signal pressure output by the first signal port and a second signal pressure output by the second signal port. A compensator in fluid communication with the first control valve and the first actuator controls fluid flow from the first control valve to the first actuator based on the resolved signal pressure.

20 Claims, 2 Drawing Sheets

PRESSURE-COMPENSATED HYDRAULIC CIRCUIT WITH REGENERATION

TECHNICAL FIELD

The invention relates generally to a fluid system having at least two different fluid circuits supplied in parallel by a common fluid source and, more particularly, to a pressure-compensated hydraulic system with regeneration, wherein the two parallel circuits have different loads that may be operated substantially simultaneously.

BACKGROUND

It is well known that when operating two different fluid circuits in parallel with a common pump, the circuit having the lightest load will automatically take the pump's flow. Likewise, the circuit with the heaviest load will stall or slow to such an extent that the operation of that circuit is severely hampered. It is also desirable in many systems with a light load to recombine the flow from one end of a cylinder to the other end. However, this has proved to be difficult since it requires special valving in the main control spool or added valving. Even then, the functioning of the heavy loaded circuit would either slow or stall. In attempts to overcome the stalling of the heavy loaded circuit, excessive pressures may be generated in the fluid system.

In some systems, for example, U.S. Pat. No. 4,617,854, the hydraulic device includes a pump and at least two consumers fluidly connected to the pump, with each of the consumers being operatively controlled by a hydraulically-controlled multiway valve. In attempting to achieve load-independent proportioning, the device is provided with an additional hydraulically-controlled multiway valve acted upon by the pump pressure and the pressure of the consumer carrying the highest pressure. The additional multiway valve, as well as other multiway control valves are operated by the pump pressure. Such a system may not be desirable because it requires additional valving and it takes operative pressure from the pump flow.

The present invention is directed to overcoming one or more of the problems as set forth above.

SUMMARY OF THE INVENTION

According to one aspect of the invention, a fluid system may include a source of pressurized fluid in operable communication with first and second actuators. A first control valve may be operable to control fluid communication to and from the first actuator. The first control valve may be structured and arranged to combine fluid flow from a second end port of the first actuator with fluid flow from the source when providing a supply of fluid to a first end port of the first actuator. The first control valve may include a first signal port in fluid communication with the supply of fluid to the first actuator. A second control valve may be operable to control fluid communication to and from the second actuator. The second control valve may include a second signal port in fluid communication with a supply of fluid to the second actuator. A resolver may be structured and arranged to output a resolved signal pressure equal to the greater of a first signal pressure output by the first signal port and a second signal pressure output by a second signal port. A compensator in fluid communication with the first control valve and the first actuator may be structured and arranged to control fluid flow from first control valve to the first actuator based on the resolved signal pressure.

According to another aspect of the invention, a method for substantially simultaneously operating at least two actuators having different loads is provided. The method includes supplying pressurized fluid to a first control valve and to a second control valve, controlling fluid flow to and from the first actuator with the first control valve, and controlling fluid flow to and from the second actuator with the second control valve. The method further includes combining exhaust flow from a second end port of the first actuator with a supply of pressurized fluid to provide a fluid flow to the first actuator, outputting a first signal pressure from the first control valve, and outputting a second signal pressure from the second control valve. The method further includes comparing the first signal pressure with the second signal pressure and controlling fluid flow from the first control valve to the first actuator based on the greater of the first signal pressure and the second signal pressure.

It is to be understood that both the foregoing general description and the following detailed description are exemplary and explanatory only and are not restrictive of the invention.

DETAILED DESCRIPTION

Figure 1:
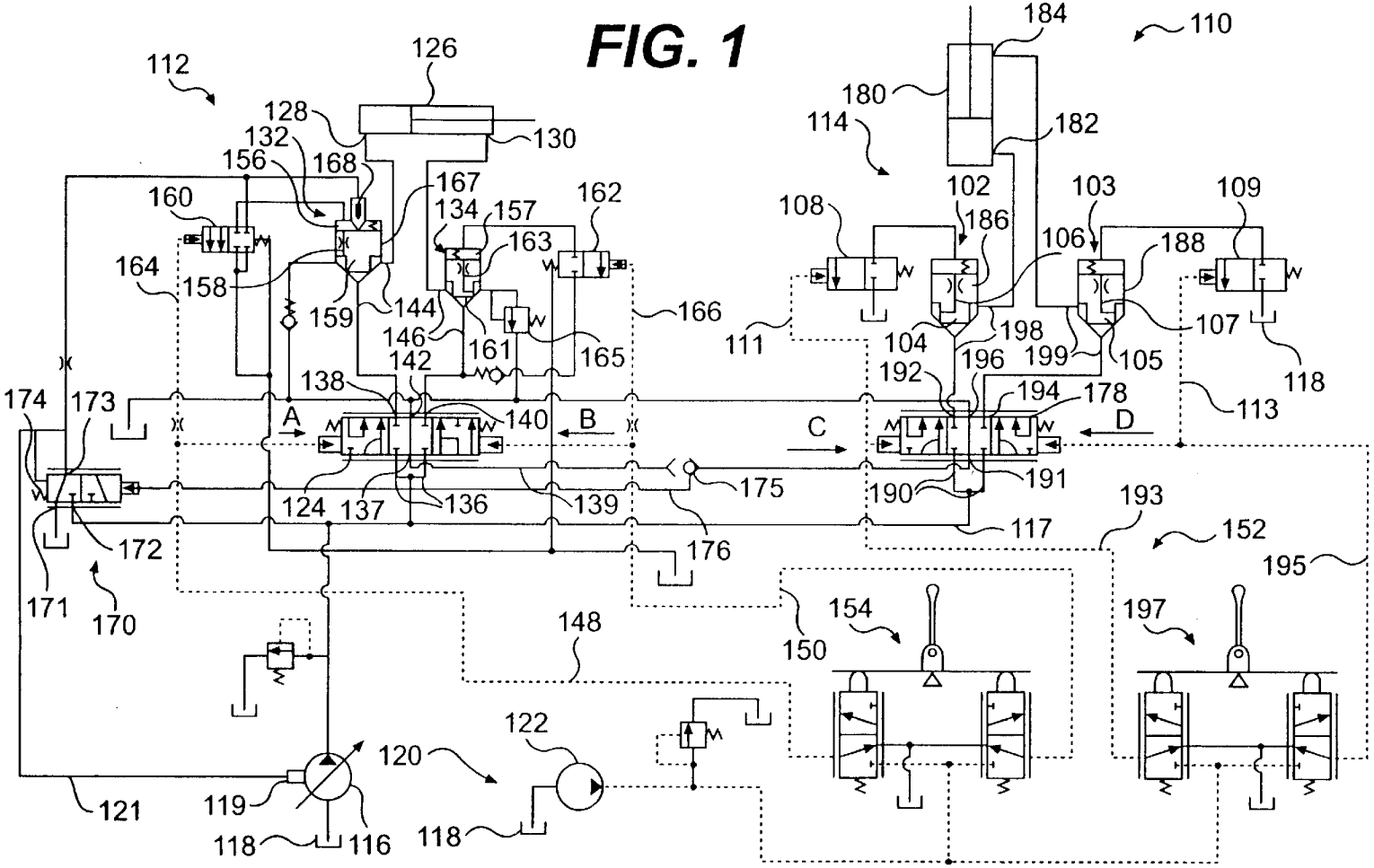
FIG. 1 is a schematic representation of a fluid system in accordance with an exemplary embodiment of the invention.

Referring to FIG. 1 of the drawings, a fluid system 110 is provided and includes first and second fluid circuits 112, 114 connected in parallel to a single source of pressurized supply fluid 116 via a supply conduit 117. The source of pressurized supply fluid 116 may receive fluid from a reservoir 118. The source of pressurized supply fluid 116 may be, for example, a load-sensing, variable-displacement pump. The source 116 may include a pressure-responsive displacement controller 119 in communication with a control conduit 121. The fluid system 110 also includes a pilot control system 120 connected to a source of pressurized pilot fluid 122.

The first fluid circuit 112 includes a first control valve 124, for example, a directional control valve, a first actuator 126 having a first end port 128 and a second end port 130, a compensator 132, and a first load check valve 134. The actuator may be, for example, a hydraulic actuator having a head end port and a rod end port. The first directional control valve 124 has a supply port 136 connected to the supply conduit 117, a signal port 137 connected to a signal conduit 139, first and second outlet ports 138, 140, and an exhaust port 142 connected to the reservoir 118. A conduit 144 connects the first outlet port 138 to the first end port 128 of the first actuator 126 and a conduit 146 connects the second outlet port 140 to the second end port 130 of the first actuator 126.

The first directional control valve 124 is movable between a center position and first and second operable positions. In the center position (shown in FIG. 1), the signal port 137 is in communication with the exhaust port 142. The supply port 136 and the first and second outlet ports 138, 140 are blocked from one another, as well as from the signal port 137 and the exhaust port 142. In the first operable position, that is, when the directional control valve 124 is moved in the direction of arrow A, the supply port 136 is in communication with the second outlet port 140 and the signal port, and the first outlet port 138 is in communication with the exhaust port 142. In the second operable position, that is, when the directional control valve 124 is moved in the direction of arrow B, the supply port 136 is in communication with the first outlet port 138 and the signal port 137, and the second outlet port 140 is in communication with the supply port 136. Consequently, in the second operable position of the first directional control valve 124, the supply port 136 is in communication with both the first and second outlet ports 138, 140 and the signal port 137.

The first directional control valve 124 is biased to its center position in a conventional manner and is moved to its first and second operable positions in response to receipt of pressurized pilot fluid from the pilot control system 120 through respective first and second pilot conduits 148, 150. A control input arrangement 152 is provided in the pilot control system 120 and includes a first operator-controlled input arrangement 154 disposed between the source of pressurized pilot fluid 122 and the first and second pilot conduits 148, 150. The first operator-controlled input arrangement 154 is operative to control the position of the directional control valve 124 in response to an input by the operator.

The compensator 132 is disposed in the conduit 144 and the first load check valve 134 is disposed in the conduit 146. Each of the compensator 132 and the first load check valve 134 is operative to permit flow to the first actuator 126 and selectively block flow from the first actuator 126. Each of the compensator 132 and the first load check valve 134 has a pressure chamber 156, 157 defined therein behind the respective valving element 159, 161, respectively. The pressure chamber 156 of the compensator 132 is connected to the first end port 128 of the first actuator 126 through orificed conduit 158. The pressure chamber 157 of the first load check valve 134 is connected to the second end port 130 of the first actuator 126 through orificed conduit 163. A relief valve 165 may be disposed between the first load check valve 134 and the reservoir 118.

The compensator 132 may be configured, for example, as a load check valve 167, including a piston 168 disposed at its pressure chamber 156. A working surface of the piston 168 is in communication with the control conduit 121. The pressure chamber 156 of the compensator 132 may be communicated to the reservoir 118 in response to receipt of pressurized pilot fluid from the pilot control system 120 through the first pilot conduit 148.

The fluid system 110 may include a duplicating valve 170 having a first port 171, a second port 172, and an outlet port 173. The outlet port 173 is in communication with the control conduit 121, the first port 171 is in communication with the reservoir 118, and the second port 172 is in communication with the supply conduit 117. The duplicating valve 170 is movable between first and second operable positions. In the first operable position, as shown in FIG. 1, the first port 171 is in communication with the outlet port 173, and the second port 172 is blocked off from the outlet port 173. In the second operable position, the second port 172 is in communication with the outlet port 173, and the first port 171 is blocked off from the outlet port 173. The duplicating valve 170 is biased to its first position by fluid from the control conduit 121 and a biasing member 174. The duplicating valve 170 may be moved to its second operable position in response to receipt of pressurized fluid from the signal conduit 139.

First and second two-position valves 160, 162 are disposed between the respective pressure chambers 156, 157 and the reservoir 118. Each of first and second two-position valves 160, 162 is spring-biased to a flow blocking position and movable to a flow passing position in response to receipt of pressurized fluid through respective conduits 164, 166 that are respectively connected to pilot conduits 148, 150.

The first two-position valve 160 is a four-way valve. In the absence of pressurized pilot fluid from the pilot control system 120 through the first pilot conduit 148, a first operable position of the first two-position valve 160 (shown in FIG. 1) blocks fluid flow from the control conduit 121 and the pressure chamber 156 of the compensator 132 to the reservoir 118. In response to receipt of pressurized pilot fluid from the pilot control system 120 through the first pilot conduit 148, the first two-position valve 160 moves to a second operable position and provides fluid communication from the control conduit 121 and the pressure chamber 156 of the compensator 132 to the reservoir 118.

The second two-position valve 162 is a two-way valve. In the absence of pressurized pilot fluid from the pilot control system 120 through the second pilot conduit 150, a first operable position of the second two-position valve 160 (shown in FIG. 1) blocks fluid flow from the pressure chamber 156 of the first load check valve 134 to the second outlet port 140. In response to receipt of pressurized pilot fluid from the pilot control system 120 through the second pilot conduit 150, the second two-position valve 162 moves to a second operable position and provides fluid communication from the pressure chamber 157 of the first load check valve 134 to the second outlet port 140 where the fluid flow is regenerated to the first end port 128 of the first actuator 126.

The second fluid circuit 114 includes a second control valve 178, for example, a directional control valve, a second actuator 180 having a first end port 182 and a second end port 184, and second and third load check valves 186, 188. The second actuator 180 may be a hydraulic cylinder having a head end port and a rod end port. The second directional control valve 178 has a supply port 190 connected to the supply conduit 117, a signal port 191 connected to the signal conduit 139, first and second outlet ports 192, 194, and an exhaust port 196 connected to the reservoir 118. A conduit 198 connects the first outlet port 192 to the first end port 182 of the second actuator 180 and a conduit 199 connects the second outlet port 194 to the second end port 184 thereof.

The second directional control valve 178 is movable between a center position and first and second operable positions. In the center position (shown in FIG. 1), the signal port 191 is in communication with the exhaust port 196. The supply port 190 and the first and second outlet ports 192, 194 are blocked from one another, as well as from the signal port 191 and the exhaust port 196. In the first operable position, that is, when the directional control valve 124 is moved in the direction of arrow C, the supply port 190 is in communication with the second outlet port 194 and the signal port 191, and the first outlet port 192 is in communication with the exhaust port 196. In the second operable position, that is, when the directional control valve 124 is moved in the direction of arrow D, the supply port 190 is in communication with the first outlet port 192 and the signal port 191, and the second outlet port 194 is in communication with the exhaust port 196.

The second directional control valve 178 is biased to its center position in a conventional manner and is moved to its first and second operable positions in response to receipt of pressurized pilot fluid from the pilot control system 120 through respective third and fourth pilot conduits 193, 195.

The control input arrangement 152 further includes a second operator-controlled input arrangement 197 disposed between the source of pressurized pilot fluid 122 and the first and second pilot conduits 193, 195. The second operator-controlled input arrangement 197 is operative to control the position of the second direction control valve 178 in response to an input by the operator.

The second load check valve 186 is disposed in the conduit 198 and the third load check valve 188 is disposed in the conduit 199. Each of the second and third load check valves 186, 188 is operative to permit flow to the second actuator 180 and selectively block flow therefrom. Each of the second and third load check valves 186, 188 also has a pressure chamber 102, 103, respectively, defined therein behind a respective valving element 104, 105. The pressure chambers 102, 103 of the second and third load check valves 186, 188 are connected to the respective first end port 182 and second end port 184 of the second actuator 180 through orificed conduits 106, 107.

Third and fourth two-position valves 108, 109 are disposed between the respective pressure chambers 102, 103 and the reservoir 118. Each of third and fourth two-position valves 108, 109 is spring-biased to a flow blocking position and movable to a flow passing position in response to receipt of pressurized fluid through respective pilot conduits 111, 113 that are respectively connected to pilot conduits 193, 195.

The fluid system 110 includes a resolver 175, for example, a single-ball resolver, disposed in the signal conduit 139. The resolver 175 may receive fluid signals from the first and second fluid circuits 112, 114. The resolver 175 may output a resolved, control signal to the signal duplicating valve 170 via a control conduit 176.

Alternatively, the working surface of the piston 168 may be reduced to an area slightly less than the seat area of the valving element 159 of the compensator 132, and the duplicating valve 170 may be eliminated. Since the working area of the piston 168 is less than the working area of the compensator 132, the compensator 132 is able to open even if the signal pressure acting on the piston is the same as the fluid pressure acting on the valving element 159 of the compensator 132.

Figure 2:
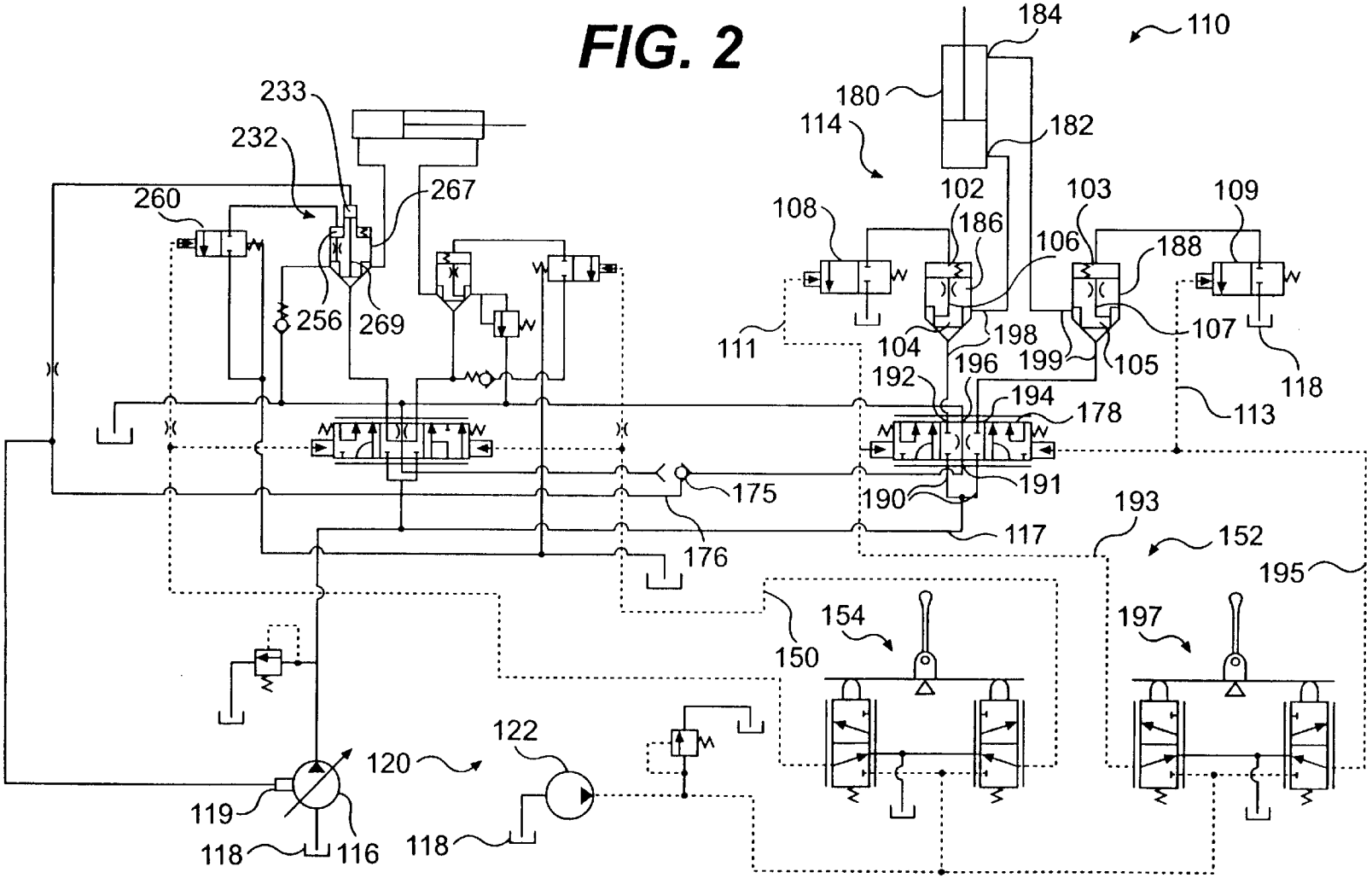
FIG. 2 is a schematic representation of a fluid system in accordance with another exemplary embodiment of the invention.

Referring to FIG. 2, another exemplary embodiment of the subject invention is disclosed. Like elements have like element numbers. FIG. 2 is similar to FIG. 1, except that rather than using a separate piston, the compensator 232 includes a signal area 233 in communication with the control conduit 176 and a pressure chamber 256 in communication with the resolver 175. The load check portion 267 of the compensator 232 includes a hole 269 through its center. In addition, the duplicating valve is not needed and the first two-position valve 260 is simplified from a four port valve to a two port valve. As in the previous aspect, the first two-position valve 260 is spring-biased to a flow blocking position and movable to a flow passing position in response to receipt of pressurized fluid through conduit 164 that is connected to the pilot conduit 148.

It is recognized that various components and/or arrangement could be used in the subject fluid system 110 without departing from the essence of the subject invention.

Industrial Applicability

In the operation of the exemplary fluid system 10 of FIG. 1, for example, the first fluid circuit 112 normally has a lighter load than the second fluid circuit 114. This is typical in machines, such as loaders, wherein the first fluid circuit 112 is a circuit for dumping a bucket and the second fluid circuit 114 is a circuit for lifting the bucket.

If the operator desires to lift the bucket, he makes the desired input through the second operator controlled input arrangement 197. A pilot signal is directed through the pilot conduit 195 to move the directional control valve 178 towards its second operable position. This permits the pressurized flow in the supply conduit 190 from the fluid source 116 to pass therethrough to the first end port 182 of the second actuator 180 to extend the second actuator thus raising the bucket. The pressurized fluid acting on the valving element 104 of the second load check valve 186 moves it to a flow passing position in a conventional manner.

The exhaust flow from the second end port 184 returns to the reservoir 118 through the conduit 199, across the third load check valve 188 and through the second outlet port 194 and the exhaust port 196 of the directional control valve 178. Since the pilot signal in the pilot conduit 195 is also directed to the fourth two-position valve 109 moving it to its flow passing position, the pressure chamber 103 of the third load check valve 188 is open to the reservoir 118 thus permitting the valving element 105 to lift up in a conventional manner to pass flow therethrough.

If it is desired to lower the load, i.e. retract the second actuator, the operator makes an input to the second operator controlled input arrangement 197 to direct pilot pressure through the pilot conduit 193 to move the directional control valve 178 towards its first operable position. In the first operable position, the supply conduit 117 is in communication with the second end port 184 through the supply port 190 and second outlet port 194, the conduit 199, and across the second load check valve 188. The valving element 105 of the third load check valve 188 moves to an open position in response to the pressurized fluid to permit fluid to flow to the second end port 184.

The exhaust flow from the first end port 182 returns to the reservoir 118 through the conduit 198, across the second load check valve 186 and through the first outlet port 192 and the exhaust port 196 of the directional control valve 178. Since the pilot signal in the pilot conduit 193 is also directed to the third two-position valve 108 moving it to its flow passing position, the pressure chamber 102 of the second load check valve 186 is open to the reservoir 118 thus permitting the valving element 104 to lift up in a conventional manner to pass flow therethrough.

When it is desired to retract the first actuator 126, or rack the bucket back, the operator makes an input to the first operator controlled input arrangement 154 to direct pressurized pilot fluid into the pilot conduit 148 thus moving the first directional control valve 124 towards its first operable position. In the first operable position, the supply conduit 117 is connected to the second end port 130 of the first actuator 126 through the supply port 136 and second outlet port 140 of the first directional control valve 124, the conduit 146, and across the second load check valve 134. As previously noted, the valving element 159 is urged open by the pressurized fluid being directed to the second end port 130.

The exhaust flow from the first end port 128 is communicated to the reservoir 118 through the conduit 144, across the compensator 132, and the first outlet port 138 and exhaust port 142 of the first directional control valve 124. In this situation, the compensator 132 essentially functions as a load check, allowing exhaust fluid from the first end port 128 to flow to the directional control valve 124. As previously noted with respect to the other load check valves, the valving element 159 of the compensator 132 is moved to an open position by the first two-position valve 160 being moved to its flow passing position to vent the pressure chamber 156 and the piston 168 of the compensator 132. The first two-position valve 160 is moved to its flow passing position in response to the pressurized pilot fluid in the conduit 148 that is being directed to the first directional control valve 124.

In order to extend the first actuator 126, or dump the bucket, the operator makes an input to the first operator controlled input arrangement 154 to direct pressurized pilot fluid to the pilot conduit 150, thus moving the directional control valve 124 towards its second operable position. In the second operable position, the supply conduit 117 is connected to the first end port 128 through the supply port 136 and the first outlet port 138 of the directional control valve 124, the conduit 144, and across the compensator 132.

The exhaust flow from the second end port 130 is directed to the second outlet port 140 of the first directional control valve 124 through the conduit 146 across the second load check valve 134. The valving element 161 of the second load check valve 134 is moved to an open position in response to the second two-position valve 162 being moved to its open position by the pressure in the pilot conduit 150. The flow at the second outlet port 140 from the second end port 130 is directed across the first directional control valve 124 and combined with the fluid in the supply port 136. Consequently, the pressure of the fluid at both the first end port 128 and the second end port 130 are substantially the same. The first actuator 126 may extend due to the difference in area between the head end of the first actuator 126 and the rod end thereof. Since the force needed to dump a bucket is normally not large, the force created by the area differential is sufficient to extend the actuator or move the bucket to a dump position.

In the event the operator elects to raise the bucket by extending the second actuator 180 and simultaneously dump the load by extending the first actuator 126, the second actuator 180 will not be substantially slowed or stalled since the pump's flow will not automatically go to the lighter load (dumping of the bucket). This is true because the signal port 137 of the first directional control valve 124 is in fluid communication with the supply port 136, and the signal port 191 of the second directional control valve 178 is in communication with the supply port 190. The signal ports 137, 191 are also in fluid communication with the resolver 175 via signal conduit 139. The greater of these signal pressures communicated with the resolver 175 will open the resolver 175 and provide a resolved control signal pressure to the duplicating valve 170.

Using the resolved control signal pressure, the duplicating valve 170 provides a control signal pressure that is slightly lower than the pressure necessary to open the load check valve portion 167 of the compensator 132. The control signal pressure is communicated to the working surface of the piston 168 via the control conduit 176. This control signal pressure urges the piston 168 against the working surface of the load check valve portion 167 of the compensator. Thus, the load check valve portion 167 cannot open until the pressure of the fluid supply is slightly greater than the control signal pressure. Since the pressure required to open the load check valve portion 167 is the same as the signal pressure communicated to the pressure-responsive displacement controller 119 associated with the source of pressurized supply fluid 116, the pressure drop across the first outlet port 138 to the first end port 128 is maintained at pump margin.

Thus, the lightly loaded actuator (first actuator 126) is being subjected to substantially the same level of pressure that is being experienced by the more heavily loaded second actuator 180 due to operation of the compensator 132. Consequently, each of the first and second actuators 126, 180 will move at the rate established by the operator inputs.

In another alternative aspect of the invention, as mentioned above, the working surface of the piston 168 may be reduced to an area slightly less than the seat area of the valving element 159 of the compensator 132, and the duplicating valve 170 may be eliminated. Since the working area of the piston 168 is less than the working area of the compensator 132, the compensator 132 is able to open even if the signal pressure acting on the piston 168 is the same as the fluid pressure acting on the valving element 159 of the compensator 132. However, in this alternative, the compensator 132 only provides partial pressure compensation, and the pump margin will increase when lifting and dumping simultaneously.

The operation of the embodiment of FIG. 2 is substantially the same as that of FIG. 1 when simultaneously extending (lifting) the second actuator 180 and extending (dumping) the first actuator 126. One difference is the compensator 232 including a signal area 233 as part of the load check valve portion 267. The signal area 233 is in communication with the control conduit 176, rather than a separate piston being controlled by the duplicating valve. Since the load check portion 267 of the compensator 232 includes a hole 269 through its center, the load check valve portion 267 will open only when the pressure chamber 256 is vented by opening the first two-position valve 260. In this embodiment, the compensator 232 will only provide partial pressure compensation, and the pump margin will increase when lifting and dumping simultaneously.

In view of the foregoing, it is readily apparent that the fluid system of the invention is a simple and reliable arrangement that ensures that two different circuits may be operated in parallel without one or the other of the actuators substantially slowing or stalling. This remains true even if one of the actuators is lightly loaded, while the other of the actuators is more heavily loaded.

Other aspects, objects and advantages of the invention can be obtained from a study of the drawings, the disclosure and the appended claims.

What is claimed is:

1. A fluid system, comprising:

a source of pressurized fluid;

a first actuator in operable communication with the source of pressurized fluid, the first actuator including a first end port and a second end port;

a first control valve operable to control fluid communication to and from the first actuator, the first control valve being structured and arranged to combine fluid flow from the second end port with fluid flow from the source of pressurized fluid when providing a supply of fluid to the first end port, the first control valve including a first signal port in fluid communication with the supply of fluid to the first actuator, the first signal port being configured to output a first signal pressure;

a second actuator in operable communication with the source of pressurized fluid;

a second control valve operable to control fluid communication to and from the second actuator, the second control valve including a second signal port in fluid communication with a supply of fluid to the second actuator, the second signal port being configured to output a second signal pressure;

a resolver in fluid communication with the first signal port and the second signal port, the resolver being structured and arranged to output a resolved signal pressure equal to a greater of the first signal pressure and the second signal pressure;

a compensator in fluid communication with the first control valve and the first actuator, the compensator structured and arranged to control fluid flow from the first control valve to the first actuator based on the resolved signal pressure; and a duplicating valve in fluid communication with the source of pressurized fluid, the resolved signal pressure, and the compensator.

2. The system of claim 1, wherein the compensator includes a load check valve and a piston, the piston including a working surface in fluid communication with the duplicating valve.

3. The system of claim 2, wherein the duplicating valve is structured and arranged to provide a control signal pressure to the working surface of the piston.

4. The system of claim 3, wherein the control signal pressure is less than a pressure of the supply of fluid to the first end port of the first actuator.

5. A fluid system, comprising:

a source of pressurized fluid;

a first actuator in operable communication with the source of pressurized fluid, the first actuator including a first end port and a second end port;

a first control valve operable to control fluid communication to and from the first actuator, the first control valve being structured and arranged to combine fluid flow from the second end port with fluid flow from the source of pressurized fluid when providing a supply of fluid to the first end port, the first control valve including a first signal port in fluid communication with the supply of fluid to the first actuator, the first signal port being configured to output a first signal pressure;

a second actuator in operable communication with the source of pressurized fluid;

a second control valve operable to control fluid communication to and from the second actuator, the second control valve including a second signal port in fluid communication with a supply of fluid to the second actuator, the second signal port being configured to output a second signal pressure;

a resolver in fluid communication with the first signal port and the second signal port, the resolver being structured and arranged to output a resolved signal pressure equal to a greater of the first signal pressure and the second signal pressure;

a compensator in fluid communication with the first control valve and the first actuator, the compensator structured and arranged to control fluid flow from the first control valve to the first actuator based on the resolved signal pressure; and a first load check valve disposed between an outlet port of the first control valve and the second end port of the first actuator.

6. The system of claim 5, wherein the compensator includes a valving element having a first working surface area and a piston having a second working surface area in fluid communication with the resolver, the second working surface area being less than the first working surface area.

7. The system of claim 5, wherein the compensator includes a load check valve with a signal area and an opposed working surface, the signal area being in fluid communication with the resolver.

8. The system of claim 5, including a pilot control system having a source of pressurized pilot fluid and a control input arrangement connected to the source of pressurized pilot fluid, the first control valve and the second control valve being movable in response to receipt of pressurized pilot fluid being directed from the control input arrangement.

9. The system of claim 5, wherein the resolver includes a single ball resolver.

10. The system of claim 5, wherein, when the second actuator experiences a greater load than the first actuator, fluid flow from the first control valve to the first end port of the first actuator is blocked by the compensator.

11. A fluid system, comprising:

a source of pressurized fluid;

a first actuator in operable communication with the source of pressurized fluid, the first actuator including a first end port and a second end port;

a first control valve operable to control fluid communication to and from the first actuator, the first control valve being structured and arranged to combine fluid flow from the second end port with fluid flow from the source of pressurized fluid when providing a supply of fluid to the first end port, the first control valve including a first signal port in fluid communication with the supply of fluid to the first actuator, the first signal port being configured to output a first signal pressure;

a second actuator in operable communication with the source of pressurized fluid;

a second control valve operable to control fluid communication to and from the second actuator, the second control valve including a second signal port in fluid communication with a supply of fluid to the second actuator, the second signal port being configured to output a second signal pressure;

a resolver in fluid communication with the first signal port and the second signal port, the resolver being structured and arranged to output a resolved signal pressure equal to a greater of the first signal pressure and the second signal pressure;

a compensator in fluid communication with the first control valve and the first actuator, the compensator structured and arranged to control fluid flow from the first control valve to the first actuator based on the resolved signal pressure; and a two-position valve in fluid communication with the compensator and a reservoir.

12. The system of claim 11, wherein the compensator includes a piston and a pressure chamber, the two-position valve being operable to provide fluid communication between the piston and reservoir and between the pressure chamber and the reservoir.

13. The system of claim 11, wherein the resolver includes a single ball resolver.

14. The system of claim 11, wherein, when the second actuator experiences a greater load than the first actuator, fluid flow from the first control valve to the first end port of the first actuator is blocked by the compensator.

15. The system of claim 14, wherein the compensator allows fluid communication between the first control valve and the first end port of the first actuator when the first actuator experiences substantially a same load as the second actuator.

16. A method for substantially simultaneously operating at least two actuators having different loads, comprising:

supplying pressurized fluid to a first control valve and to a second control valve;

controlling fluid flow to and from the first actuator with the first control valve;

controlling fluid flow to and from the second actuator with the second control valve;

combining exhaust flow from a second end port of the first actuator with a supply of pressurized fluid to provide a fluid flow to a first end port of the first actuator;

outputting a first signal pressure from the first control valve;

outputting a second signal pressure from the second control valve;

generating a resolved signal pressure based on the greater of the first signal pressure and the second signal pressure;

controlling fluid flow from the first control valve to the first actuator based on the resolved signal pressure;

operating a duplicating valve with the resolved signal pressure to generate a control signal pressure; and supplying the control signal pressure to a compensator disposed in fluid communication between the first control valve and the first end port of the first actuator.

17. The method of claim 16, further including blocking fluid flow from the first control valve to the first end port with the compensator until a pressure of fluid being supplied to the first end port exceeds the control signal pressure.

18. The method of claim 17, further including, when the second actuator experiences a greater load than the first actuator, blocking fluid flow from the first control valve to the first end port of the first actuator.

19. The method of claim 18, further including, when the first actuator experiences substantially a same load as the second actuator, allowing fluid communication between the first control valve and the first end port.

20. A fluid system, comprising:

a source of pressurized fluid;

a first cylinder in operable communication with the source of pressurized fluid, the first cylinder including a first end port and a second end port;

a first control valve operable to control fluid communication to and from the first cylinder, the first control valve being structured and arranged to combine fluid flow from the second end port with fluid flow from the source of pressurized fluid when providing a supply of fluid to the first end port, the first control valve including a first signal port in fluid communication with the supply of fluid to the first cylinder, the first signal port being configured to output a first signal pressure;

a second cylinder in operable communication with the source of pressurized fluid;

a second control valve operable to control fluid communication to and from the second cylinder, the second control valve including a second signal port in fluid communication with a supply of fluid to the second cylinder, the second signal port being configured to output a second signal pressure;

a resolver in fluid communication with the first signal port and the second signal port, the resolver being structured and arranged to output a resolved signal pressure equal to a greater of the first signal pressure and the second signal pressure;

a compensator in fluid communication with the first control valve and the first cylinder, the compensator structured and arranged to control fluid flow from the first control valve to the first cylinder based on the resolved signal pressure, the compensator including a load check valve and a piston; and a duplicating valve in fluid communication with the source of pressurized fluid, the resolved signal pressure, and the compensator, the duplicating valve being structured and arranged to provide a control signal pressure to a working surface of the piston.

* * * * *